US012618628B2

(12) United States Patent
Hussey

(10) Patent No.: US 12,618,628 B2
(45) Date of Patent: May 5, 2026

(54) FORGED CARBON FIBER RIFLE BARREL

(71) Applicant: Grey Birch MFG, Tampa, FL (US)

(72) Inventor: Jeff Hussey, Tampa, FL (US)

(73) Assignee: Grey Birch MFG, Tampa, FL (US)

( * ) Notice: Subject to any disclaimer, the term of this patent is extended or adjusted under 35 U.S.C. 154(b) by 0 days.

(21) Appl. No.: 19/080,371

(22) Filed: Mar. 14, 2025

(65) Prior Publication Data

US 2025/0290719 A1 Sep. 18, 2025

Related U.S. Application Data

(60) Provisional application No. 63/565,427, filed on Mar. 14, 2024.

(51) Int. Cl.
*F41A 21/02* (2006.01)
*F41A 21/20* (2006.01)

(52) U.S. Cl.
CPC ..... *F41A 21/02* (2013.01); *F41A 21/20* (2013.01)

(58) Field of Classification Search
CPC ..... F41A 21/02; F41A 21/20
See application file for complete search history.

(56) References Cited

U.S. PATENT DOCUMENTS

| | | | | |
|---|---|---|---|---|
| 6,230,429 | B1 * | 5/2001 | Smith | F41A 21/02 42/76.01 |
| 6,889,464 | B2 * | 5/2005 | Degerness | F41A 21/02 42/76.01 |
| 9,677,845 | B2 * | 6/2017 | Cook, Jr. | F41C 23/16 |
| 10,168,117 | B2 * | 1/2019 | Curliss | F41A 21/20 |
| 11,079,194 | B1 * | 8/2021 | Sinnema | F41A 21/02 |
| 11,385,013 | B2 * | 7/2022 | Boretto | F41A 21/02 |
| 12,061,059 | B2 * | 8/2024 | Glisovic | B23P 11/025 |
| 2019/0310044 | A1 * | 10/2019 | Glisovic | F41A 21/20 |
| 2022/0163280 | A1 * | 5/2022 | Boretto | F41A 21/04 |
| 2024/0337456 | A1 * | 10/2024 | Hussey | B29C 53/582 |

* cited by examiner

*Primary Examiner* — Joshua E Freeman
(74) *Attorney, Agent, or Firm* — Banner & Witcoff, Ltd.

(57) ABSTRACT

A method of forming a carbon fiber rifle barrel may include the steps of heating a barrel core to increase the length of the barrel, placing the barrel core inside a mold and holding the lengthened barrel in place, adding a carbon fiber mix to the mold in which the carbon fiber mix includes a blend of resin and chopped carbon fibers, sealing the mold, curing the carbon fiber mix surrounding the lengthened barrel core in which the cured carbon fiber mix holds the length of the barrel core creating a tension on the cooled barrel core which increases a rigidity of the rifle barrel thereby increasing the accuracy of the rifle barrel, removing the rifle barrel from the mold, and finishing the rifle barrel via grinding to a desired finish.

20 Claims, 4 Drawing Sheets

FORGED CARBON FIBER RIFLE BARREL

CROSS REFERENCE TO RELATED APPLICATIONS

This application claims benefit to U.S. Provisional Application No. 63/565,427, filed Mar. 14, 2024 entitled Forged Carbon Fiber Rifle Barrel. All of the above application is incorporated herein by reference.

BACKGROUND

Firearm barrels have traditional made of metals and alloys, and in particular, steel. To increase the life of a barrel and the number of rounds that may be fired through the barrel, prior art methods of manufacturing barrels relied upon using increased amounts of steel resulting in a stronger, but heavier barrel.

Barrels with increased weight are generally disfavored. Firearms with heavy barrels become more difficult to transport during hunting and military operations. A barrel with increased strength, longer lifespan, and lighter in weight is desirable.

A barrel formed from a carbon composite and steel may have an extremely reduced weight and greater service life compared to conventional metal and alloy firearm barrels and may be more accurate due to increased rigidity compared to conventional rifle barrels.

SUMMARY

This Summary is provided to introduce a selection of concepts in a simplified form that are further described below in the Detailed Description. The Summary is not intended to identify key features or essential features of the claimed subject matter, nor is it intended to be used to limit the scope of the claimed subject matter.

In accordance with one aspect, method of forming a rifle barrel may include the steps of placing a barrel core or a mandrel comprising the barrel core inside a mold, placing additional materials around the barrel core or the mandrel, adding a carbon fiber mix to the mold, wherein the carbon fiber mix comprises a blend of resin and carbon fibers, sealing the mold, curing the mold with or without heating, removing the cured barrel core from the mold, and finishing the barrel via grinding to the desired finish. In some examples, a replacement rifle barrel kit for a firearm may include the finished rifle barrel described above. In other examples, a firearm may include the rifle barrel described above.

In accordance with another aspect, a method of forming a rifle barrel may include the steps of placing a barrel core or a mandrel comprising the barrel core inside a mold, placing additional materials around the barrel core or the mandrel, adding a carbon fiber mix to the mold, wherein the carbon fiber mix comprises a blend of resin and carbon fibers, sealing the mold, heating the mold to grow a length of the barrel core, holding the heated barrel core length in place, curing the carbon fiber mix, cooling the barrel core, wherein the cured carbon fiber mix causes a tension on the barrel core when the length of the barrel core decreases due to cooling, and wherein the tension increases a rigidity of the rifle barrel, removing the cured barrel core from the mold, and finishing the barrel via grinding to the desired finish. In some examples, a replacement rifle barrel kit for a firearm may include the finished rifle barrel described above. In other examples, a firearm may include the rifle barrel described above.

In accordance with other aspects herein, a firearm rifle barrel replacement kit may include a carbon fiber barrel as disclosed herein for use with a firearm, and a set of printed safety and/or installation instructions. In some examples, each component may be combined into a unitary packaging assembly. In other examples, the replacement carbon fiber barrel disclosed herein may include a steel barrel core, and a carbon fiber mix bonded to an exterior of the steel barrel core.

In accordance with another aspect, a method of forming a carbon fiber rifle barrel may include the steps of heating a barrel core in which the heating increases a length of the barrel core, placing the barrel core inside a mold and holding the lengthened barrel core in place creating a tension, adding a carbon fiber mix to the mold in which the carbon fiber mix may include a blend of resin and chopped carbon fibers, sealing the mold, curing the carbon fiber mix surrounding the barrel core an din which the cured carbon fiber mix holds the lengthened barrel core in place and holding or creating tension on the barrel core thereby increases a rigidity of the rifle barrel and making the rifle barrel ore accurate, removing the rifle barrel from the mold, and finishing the rifle barrel via grinding or other technique to a desired finish.

In some examples, the barrel core may comprise steel or an alloy. In another example, the chopped carbon fibers comprise non-continuous forged carbon fibers. In one example, an x-ray detectable material is embedded in the carbon fiber mix allowing for detection in the event the rifle barrel is destroyed or damaged in combat or other incident and penetrates an individual's body. In yet another example, reinforcing fibers may be placed around the barrel core prior to adding the carbon fiber mix to the mold. In some examples, the mold may be subjected to vacuum pressure during curing. In one example, the finishing step may include centerless grinding. In another example, the finishing step may include applying a protective wax coating to the finished rifle barrel.

In still other aspects, a method of forming a carbon fiber rifle barrel may include the steps of heating a barrel core to grow a length of the barrel core, placing the barrel core or a mandrel comprising the barrel core inside a mold, holding the length of the heated barrel core in place via a mechanical fastener or clap device, adding a carbon fiber mix to the mold to surround the barrel core in which the carbon fiber mix may include a blend of resin and carbon fibers, sealing the mold, curing the carbon fiber mix with our without heating to a point in which the cured carbon fiber mix holds the extended length of the barrel core in place and creates a tension on the barrel core when the barrel core cools such that the tension increases a rigidity of the rifle barrel thereby creating a more accurate rifle barrel, removing the rifle barrel from the mold, finishing the rifle barrel via grinding or other means to a desired finish.

In some examples, the barrel core may be heated to a temperature between 200° F. and 600° F. In another example, the barrel core may be made of an alloy selected for high thermal expansion properties. In one example, the carbon fiber mix may include continuous carbon fibers oriented to enhance rigidity or chopped carbon fibers to increase rigidity. In still other examples, the tension created on the barrel core improves barrel harmonics, stiffness, rigidity, and accuracy. In certain examples, the mold may be pre-coated with a release agent before the carbon fiber mix is added. In one example, the cured rifle barrel may be wrapped with a compression tape before finishing. In some examples, curing is temperature controlled to achieve a specific rifle barrel core length contraction rate. In one example, the mold is subjected to autoclave curing for improved bonding. In another example, the barrel core may be pre-treated with an adhesion-promoting primer.

In another aspect, a method of forming a carbon fiber rifle barrel may include the steps of heating a barrel core to grow a length of the barrel core, placing a barrel core inside a mold and holding the heated barrel core length in place, adding a carbon fiber mix to the mold in which the carbon fiber mix surrounds the barrel core and the carbon fiber mix comprises a blend of resin and carbon fibers, sealing the mold, curing the carbon fiber mix such that the cured carbon fiber mix holds the length of the barrel core creating a tension on the barrel core when the length of the barrel core decreases due to cooling, and the tension increases a rigidity of the rifle barrel, removing the rifle barrel from the mold, and finishing the rifle barrel.

In a variety of embodiments, some or all of the steps of forming a carbon fiber rifle barrel described herein may be combined and/or divided into sub-steps as appropriate, and/or rearranged in a different order.

These and additional features will be appreciated with the benefit of the disclosures discussed in further detail below.

BRIEF DESCRIPTION OF THE DRAWINGS

A more complete understanding of the present invention and certain advantages thereof may be acquired by referring to the following detailed description in consideration with the accompanying drawings, in which.

DETAILED DESCRIPTION

The carbon firearm barrel disclosed herein may include a barrel core formed of steel or other metal or alloy, and an outer carbon fiber mix fused or bonded to the barrel core. The solid-core (meaning zero to minimal space between the carbon fiber mix and the bonded barrel core). The final product, a completed carbon barrel may gain its strength and stiffness primarily via the bonded carbon contacting the exterior steel of the barrel core, and the torsion or tension created when the carbon fiber mix holds the heated lengthened barrel core when it cools to create increased rigidity in the final barrel assembly. The method of making the carbon barrel, increases the strength and rigidity of the barrel resulting in a firearm barrel with increased service life, increased accuracy, and significant reduction in weight.

Moreover, by heating a barrel core to increase its length and holding the extended barrel length in place, then allowing an outer carbon fiber mix or a carbon fiber mixture to cure around the heated and extended barrel core length, and then allowing the barrel core to cool, the cured carbon mix or outer carbon fiber mix creates a tension on the overall completed rifle barrel/barrel core thereby increasing the rigidity of the rifle barrel not achievable via conventional rifle barrel manufacturing techniques. The method described herein does not use a technique of wrapping or winding a carbon fiber around a barrel core.

Figure 1:
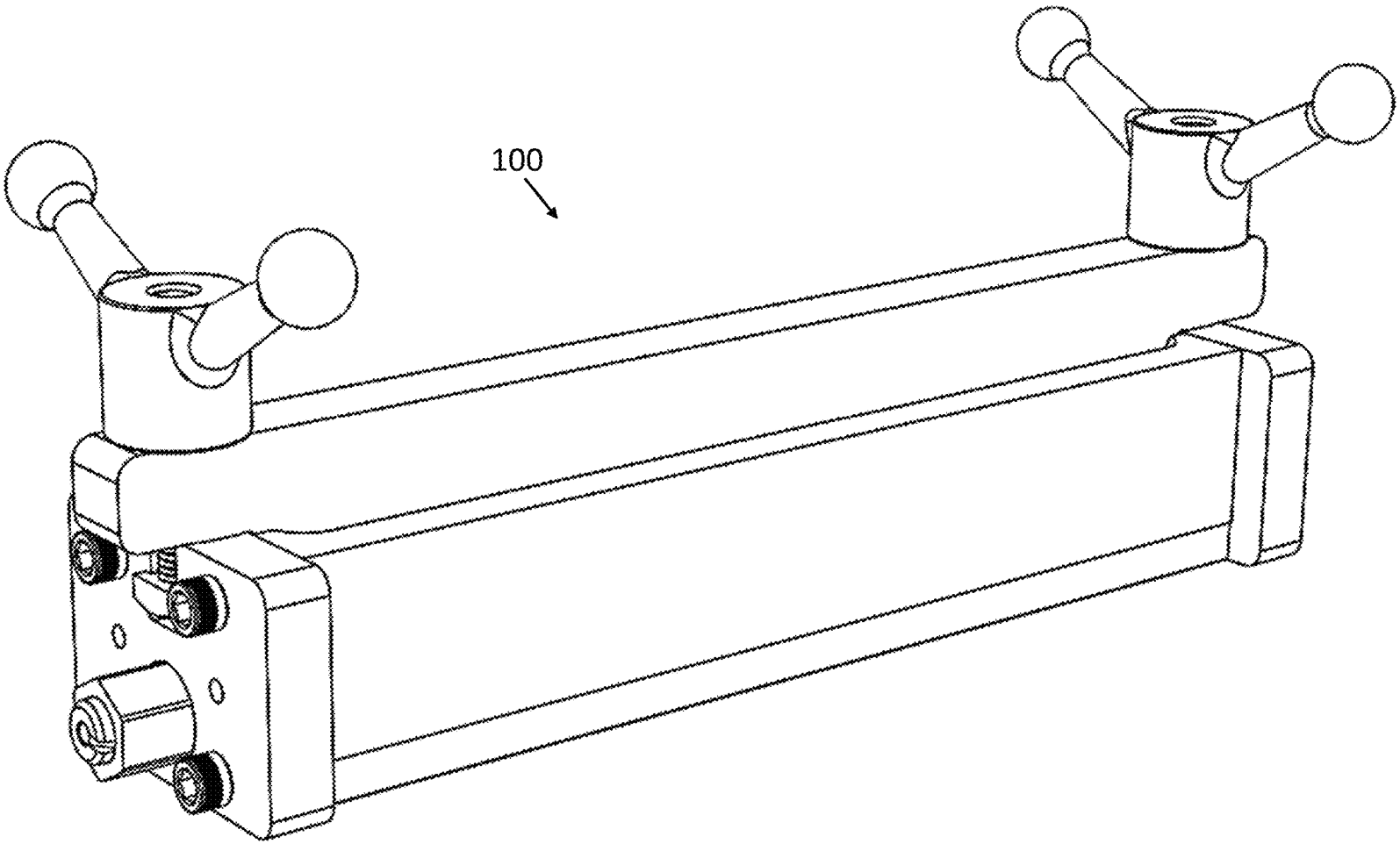
FIG. 1 depicts the carbon fiber rifle barrel mold apparatus in the sealed or closed position as disclosed herein
Figure 2:
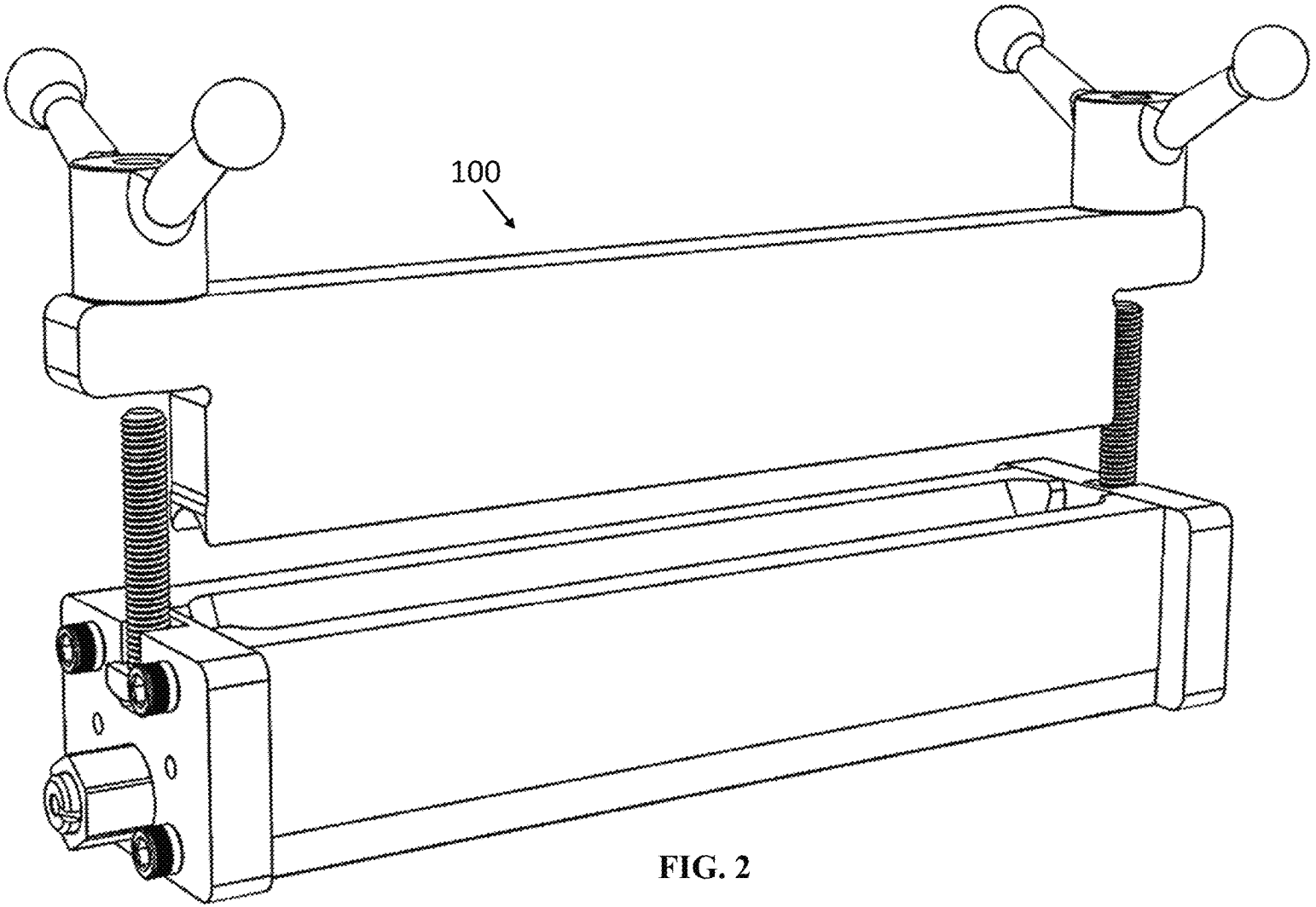
FIG. 2 depicts the carbon fiber rifle barrel mold apparatus of FIG. 1 in the unsealed or open position as disclosed herein.
Figure 3:
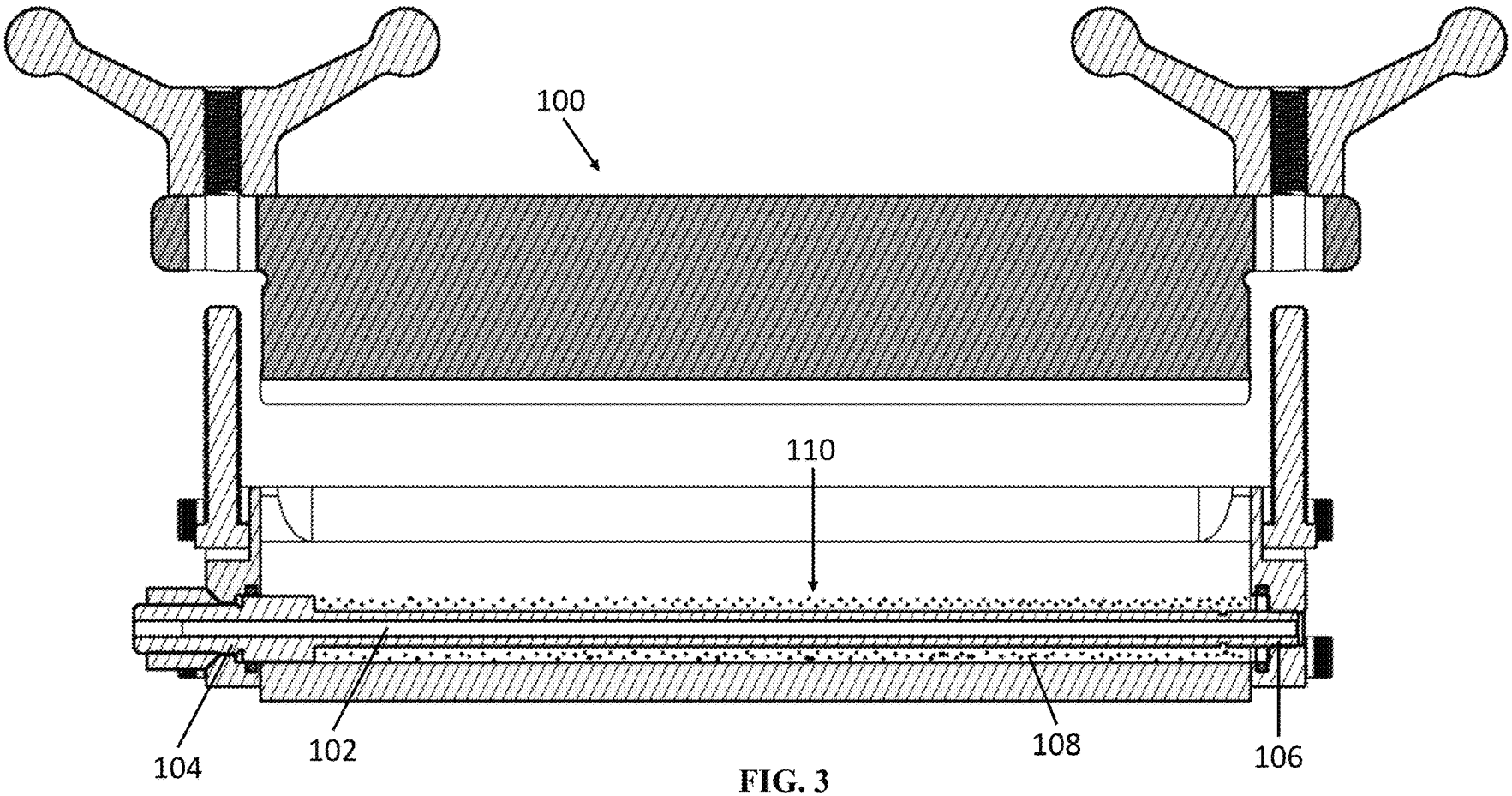
FIG. 3 depicts a side-transparent view the carbon fiber rifle barrel mold apparatus of FIG. 2 having a completed rifle barrel in the mold apparatus as disclosed herein.

As shown in FIGS. 1 and 2, a mold apparatus 100 may be configured to form a carbon fiber slurry around a rifle barrel core. As shown in FIG. 3, a heated barrel core 102 may be inserted in mold apparatus 100. The barrel core 102 proximate end 104 may be mechanically secured by a fastener or other device to mold apparatus 100. Likewise, barrel core 102 distal end 106 may be mechanically secured by a fastener or other device to mold apparatus 100. As discussed herein, heating barrel core 102 in an oven or autoclave with grow or expand the barrel length. Be securing proximate end 104 and distal end 106 of barrel core 102 to the mold apparatus 100 while the barrel core 102 is heated and expanded, the increased length of the barrel core 102 is preserved through the molding process. The barrel may expand or grow to a length that may be for example, at least, greater than, less than, equal to, or any number in between about $1000^{th}$ of an inch, $1100^{th}$ of an inch, $1200^{th}$ of an inch, $1300^{th}$ of an inch, $1400^{th}$ of an inch, $1500^{th}$ of an inch, $1600^{th}$ of an inch, $1700^{th}$ of an inch, $1800^{th}$ of an inch, $1900^{th}$ of an inch, $2000^{th}$ of an inch, $2100^{th}$ of an inch, $2200^{th}$ of an inch, $2300^{th}$ of an inch, $2400^{th}$ of an inch, $2500^{th}$ of an inch, $2600^{th}$ of an inch, $2700^{th}$ of an inch, $2800^{th}$ of an inch, $2900^{th}$ of an inch, $3000^{th}$ of an inch, $3100^{th}$ of an inch, $3200^{th}$ of an inch, $3300^{th}$ of an inch, $3400^{th}$ of an inch, $3500^{th}$ of an inch, $3600^{th}$ of an inch, $3700^{th}$ of an inch, $3800^{th}$ of an inch, $3900^{th}$ of an inch, $4000^{th}$ of an inch, $4100^{th}$ of an inch, $4200^{th}$ of an inch, $4300^{th}$ of an inch, $4400^{th}$ of an inch, $4500^{th}$ of an inch, $4600^{th}$ of an inch, $4700^{th}$ of an inch, $4800^{th}$ of an inch, $4900^{th}$ of an inch, and $5000^{th}$ of an inch. The carbon fiber mix or slurry 108 is then positioned around the barrel core 102 in mold apparatus 100. As the carbon fiber mix or slurry 108 cures and hardens, and barrel core 102 cools, the cured carbon fiber 108 encasement maintains the expanded length of barrel core 102 and the cooled barrel core 102 that tries to shrink thereby creating a tension on the completed rifle barrel 110. The tension results in a more rigid, and thus more accurate rifle barrel 110. A stiffer or more rigid rifle barrel is less prone to flexing or vibrating during shooting (or heat buildup or other environmental conditions that may warp the barrel), which can cause the bullet to exit the rifle barrel at slightly different points or with different velocities, leading to less consistent accuracy. By minimizing rifle barrel movement, a stiffer rifle barrel ensures that the bullet leaves the muzzle in a more consistent manner, resulting in a tighter grouping of shots on a target.

As disclosed herein a rifle barrel may be manufactured by creating a carbon fiber mix or encasement wrapped around a rifle barrel core using a forged carbon fiber. In some examples, the forged carbon fibers may be non-continuous, continuous, or combinations thereof. In some examples, certain portions or sections of the rifle barrel may include forged carbon fibers that may be non-continuous, continuous, or combinations thereof. In some examples, the carbon fibers may be chopped carbon fibers mixed in a resin to form a slurry.

Additional materials, compounds, other structures may be added other than resin and carbon fiber to enhance the performance or add capabilities to the fiber mix or encasement prior to or during the molding process. In some examples, an x-ray detectable material may be embedded in the carbon fiber mixture that may be detectable if a rifle barrel fails and injures the user.

In other examples, the carbon forged fiber mix or encasement may be created directly on the barrel core or on a mandrel and transferred to the barrel via slip fit bonding or shrink fit pressing.

In some examples, a mold may be used to hold the rifle barrel core or mandrel in place inside of a mold. The mold or mandrel may also hold a heated barrel that has grown in length due to heating in the molding process. Prior to adding the carbon fiber mix and/or resin, additional compounds or structures may be placed in the mold. In some examples, the forged carbon fiber mix may be any blend of resin and carbon fiber regardless of size and ratio, or additional additives in the blend. The carbon fiber mixture may be added to the mold. The mold may be sealed and the carbon fiber mixture may be allowed to cure with or without heating, or combinations thereof. In some examples the completed rifle barrel may be polished or finished using a centerless grinder or other grinder for a more precise finish.

In addition to the steps described above, the barrel core may be heated to cause an increase or extension of length of the barrel. The carbon fiber mixture may then be placed around the barrel or if already placed in the mold with the barrel, the carbon mixture may be allowed to cure. The barrel may then be allowed to cool resulting in the barrel trying to decrease in length or shrinkage. The cured carbon fiber mixture or encasement subsequently creates a tension on the barrel core resulting in a more rigid completed rifle barrel because the cooled barrel cannot decrease in length or shrink because it is held in place by the cured carbon mixture or encasement. This increased rigidity results in a more accurate rifle barrel.

The forged carbon mixture used to manufacture a cured carbon fiber mix or encasement wrapped around a barrel core may comprise a first or inner diameter that may be for example, at least, greater than, less than, equal to, or any number in between about 0.499, 0.500, 0.501, 0.502, 0.503, 0.504, 0.505, 0.506, 0.507, 0.508, 0.509, 0.510, 0.511, 0.512, 0.513, 0.514, 0.515, 0.516, 0.517, 0.518, 0.519, 0.52, 0.521, 0.522, 0.523, 0.524, 0.525, 0.526, 0.527, 0.528, 0.529, 0.53, 0.531, 0.532, 0.533, 0.534, 0.535, 0.536, 0.537, 0.538, 0.539, 0.54, 0.541, 0.542, 0.543, 0.544, 0.545, 0.546, 0.547, 0.548, 0.549, 0.55, 0.551, 0.552, 0.553, 0.554, 0.555, 0.556, 0.557, 0.558, 0.559, 0.56, 0.561, 0.562, 0.563, 0.564, 0.565, 0.566, 0.567, 0.568, 0.569, 0.57, 0.571, 0.572, 0.573, 0.574, 0.575, 0.576, 0.577, 0.578, 0.579, 0.58, 0.581, 0.582, 0.583, 0.584, 0.585, 0.586, 0.587, 0.588, 0.589, 0.59, 0.591, 0.592, 0.593, 0.594, 0.595, 0.596, 0.597, 0.598, 0.599, 0.6, 0.601, 0.602, 0.603, 0.604, 0.605, 0.606, 0.607, 0.608, 0.609, 0.61, 0.611, 0.612, 0.613, 0.614, 0.615, 0.616, 0.617, 0.618, 0.619, 0.62, 0.621, 0.622, 0.623, 0.624, 0.625, 0.626, 0.627, 0.628, 0.629, 0.63, 0.631, 0.632, 0.633, 0.634, 0.635, 0.636, 0.637, 0.638, 0.639, 0.64, 0.641, 0.642, 0.643, 0.644, 0.645, 0.646, 0.647, 0.648, 0.649, 0.65, 0.651, 0.652, 0.653, 0.654, 0.655, 0.656, 0.657, 0.658, 0.659, 0.66, 0.661, 0.662, 0.663, 0.664, 0.665, 0.666, 0.667, 0.668, 0.669, 0.67, 0.671, 0.672, 0.673, 0.674, 0.675, 0.676, 0.677, 0.678, 0.679, 0.68, 0.681, 0.682, 0.683, 0.684, 0.685, 0.686, 0.687, 0.688, 0.689, 0.69, 0.691, 0.692, 0.693, 0.694, 0.695, 0.696, 0.697, 0.698, 0.699, 0.7, 0.701, 0.702, 0.703, 0.704, 0.705, 0.706, 0.707, 0.708, 0.709, 0.71, 0.711, 0.712, 0.713, 0.714, 0.715, 0.716, 0.717, 0.718, 0.719, 0.72, 0.721, 0.722, 0.723, 0.724, 0.725, 0.726, 0.727, 0.728, 0.729, 0.73, 0.731, 0.732, 0.733, 0.734, 0.735, 0.736, 0.737, 0.738, 0.739, 0.74, 0.741, 0.742, 0.743, 0.744, 0.745, 0.746, 0.747, 0.748, 0.749, 0.75, 0.751, 0.752, 0.753, 0.754, 0.755, 0.756, 0.757, 0.758, 0.759, 0.76, 0.761, 0.762, 0.763, 0.764, 0.765, 0.766, 0.767, 0.768, 0.769, 0.77, 0.771, 0.772, 0.773, 0.774, 0.775, 0.776, 0.777, 0.778, 0.779, 0.78, 0.781, 0.782, 0.783, 0.784, 0.785, 0.786, 0.787, 0.788, 0.789, 0.79, 0.791, 0.792, 0.793, 0.794, 0.795, 0.796, 0.797, 0.798, 0.799, 0.8, 0.801, 0.802, 0.803, 0.804, 0.805, 0.806, 0.807, 0.808, 0.809, 0.81, 0.811, 0.812, 0.813, 0.814, 0.815, 0.816, 0.817, 0.818, 0.819, 0.82, 0.821, 0.822, 0.823, 0.824, 0.825, 0.826, 0.827, 0.828, 0.829, 0.83, 0.831, 0.832, 0.833, 0.834, 0.835, 0.836, 0.837, 0.838, 0.839, 0.84, 0.841, 0.842, 0.843, 0.844, 0.845, 0.846, 0.847, 0.848, 0.849, 0.85, 0.851, 0.852, 0.853, 0.854, 0.855, 0.856, 0.857, 0.858, 0.859, 0.86, 0.861, 0.862, 0.863, 0.864, 0.865, 0.866, 0.867, 0.868, 0.869, 0.87, 0.871, 0.872, 0.873, 0.874, 0.875, 0.876, 0.877, 0.878, 0.879, 0.88, 0.881, 0.882, 0.883, 0.884, 0.885, 0.886, 0.887, 0.888, 0.889, and 0.890, inches.

In some aspects, the second or outer diameter of the cured carbon fiber mix or encasement may be for example, at least, greater than, less than, equal to, or any number in between about 0.890, 0.891, 0.892, 0.893, 0.894, 0.895, 0.896, 0.897, 0.898, 0.899, 0.900, 0.901, 0.902, 0.903, 0.904, 0.905, 0.906, 0.907, 0.908, 0.909, 0.910, 0.911, 0.912, 0.913, 0.914, 0.915, 0.916, 0.917, 0.918, 0.919, 0.920, 0.921, 0.922, 0.923, 0.924, 0.925, 0.926, 0.927, 0.928, 0.929, 0.93, 0.931, 0.932, 0.933, 0.934, 0.935, 0.936, 0.937, 0.938, 0.939, 0.940, 0.941, 0.942, 0.943, 0.944, 0.945, 0.946, 0.947, 0.948, 0.949, 0.950, 0.951, 0.952, 0.953, 0.954, 0.955, 0.956, 0.957, 0.958, 0.959, 0.960, 0.961, 0.962, 0.963, 0.964, 0.965, 0.966, 0.967, 0.968, 0.969, 0.97, 0.971, 0.972, 0.973, 0.974, 0.975, 0.976, 0.977, 0.978, 0.979, 0.980, 0.981, 0.982, 0.983, 0.984, 0.985, 0.986, 0.987, 0.988, 0.989, 0.990, 0.991, 0.992, 0.993, 0.994, 0.995, 0.996, 0.997, 0.998, and 0.999 inches.

As disclosed herein, the carbon fiber mix for making carbon fiber mix or encasement may include prepreg carbon fibers and resin. Use of a dry prepreg may also provide superior technique providing surprising results and improvements over prior art and conventional firearm barrels.

After the wrapping of carbon fiber to form the carbon fiber mix 108 is complete, the fiber mix may be heated until cured in an autoclave or other oven as known in the art. In some examples, the cured carbon fiber mix 108 may be wrapped with a compression tape prior to heating to hold the carbon fibers in place until the resin cures. The completed carbon fiber rifle barrel 110 may then be removed from the mold 100.

The barrel core may be made of any steel. In some examples, barrel core may be steel, other metal, alloy, or combinations thereof. The rifle barrel diameter and surface that the carbon fiber mix is to be bonded to may be, for example, at least, greater than, less than, equal to, or any number in between about 0.250, 0.251, 0.252, 0.253, 0.254, 0.255, 0.256, 0.257, 0.258, 0.259, 0.260, 0.261, 0.262, 0.263, 0.264, 0.265, 0.266, 0.267, 0.268, 0.269, 0.270, 0.271, 0.272, 0.273, 0.274, 0.275, 0.276, 0.277, 0.278, 0.279, 0.280, 0.281, 0.282, 0.283, 0.284, 0.285, 0.286, 0.287, 0.288, 0.289, 0.29, 0.291, 0.292, 0.293, 0.294, 0.295, 0.296, 0.297, 0.298, 0.299, 0.3, 0.301, 0.302, 0.303, 0.304, 0.305, 0.306, 0.307, 0.308, 0.309, 0.31, 0.311, 0.312, 0.313, 0.314, 0.315, 0.316, 0.317, 0.318, 0.319, 0.32, 0.321, 0.322, 0.323, 0.324, 0.325, 0.326, 0.327, 0.328, 0.329, 0.33, 0.331, 0.332, 0.333, 0.334, 0.335, 0.336, 0.337, 0.338, 0.339, 0.34, 0.341, 0.342, 0.343, 0.344, 0.345, 0.346, 0.347, 0.348, 0.349, 0.35, 0.351, 0.352, 0.353, 0.354, 0.355, 0.356, 0.357, 0.358, 0.359, 0.36, 0.361, 0.362, 0.363, 0.364, 0.365, 0.366, 0.367, 0.368, 0.369, 0.37, 0.371, 0.372, 0.373, 0.374, 0.375, 0.376, 0.377, 0.378, 0.379, 0.38, 0.381, 0.382, 0.383, 0.384, 0.385, 0.386, 0.387, 0.388, 0.389, 0.39, 0.391, 0.392, 0.393, 0.394, 0.395, 0.396, 0.397, 0.398, 0.399, 0.4, 0.401, 0.402, 0.403, 0.404, 0.405, 0.406, 0.407, 0.408, 0.409, 0.41, 0.411, 0.412, 0.413, 0.414, 0.415, 0.416, 0.417, 0.418, 0.419, 0.42, 0.421, 0.422, 0.423, 0.424, 0.425, 0.426, 0.427, 0.428, 0.429, 0.43, 0.431, 0.432, 0.433, 0.434, 0.435, 0.436, 0.437, 0.438, 0.439, 0.44, 0.441, 0.442, 0.443, 0.444, 0.445, 0.446, 0.447, 0.448, 0.449, 0.45, 0.451, 0.452, 0.453, 0.454, 0.455, 0.456, 0.457, 0.458, 0.459, 0.46, 0.461, 0.462, 0.463, 0.464, 0.465, 0.466, 0.467, 0.468, 0.469, 0.47, 0.471, 0.472, 0.473, 0.474, 0.475, 0.476, 0.477, 0.478, 0.479, 0.48, 0.481, 0.482, 0.483, 0.484, 0.485, 0.486, 0.487, 0.488, 0.489, 0.49, 0.491, 0.492, 0.493, 0.494, 0.495, 0.496, 0.497, 0.498, and 0.499 inches.

In other examples, the carbon fiber mix may be bonded to the rifle barrel core via an epoxy, or other adhesive known in the art. The rifle barrel end may be threaded to allow for end cap to be threaded on to rifle barrel core to retain additional tension, and cap the carbon fiber mix encasement.

After a cure period, the encased rifle barrel may be fed into a grinder for finishing to reduce and/or eliminate circular striations, rings, or other defects. In other examples, after curing, the rifle barrel may be grinded/polished on a centerless grinder with a brass blade installed to create a finished product. When complete, the rifle barrels are treated with a wax to seal the barrel and prevent any penetration by moisture.

Figure 4:
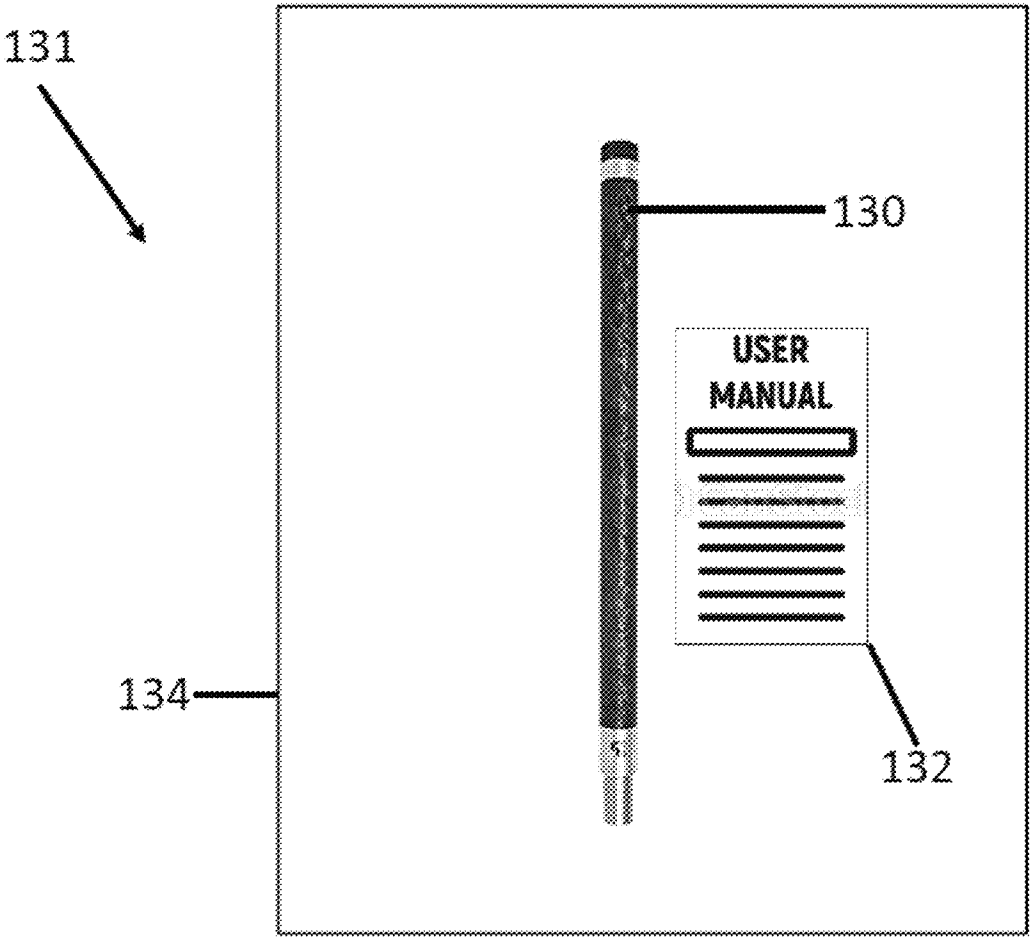
FIG. 4 depicts a firearm rifle barrel replacement kit as disclosed herein.

FIG. 4 depicts a firearm rifle barrel replacement kit 131 that may include a solid-core carbon fiber barrel assembly 130 and a set of safety/installation instructions 132. In some examples, the components may be contained with a unitary packaging assembly 132.

The following examples are set forth as being representative of the present disclosure. These examples are not to be construed as limiting the scope of the present disclosure as these and other equivalent embodiments will be apparent in view of the present disclosure, figures and accompanying claims.

What is claimed is:

1. A method of forming a rifle barrel comprising the steps of:

heating a barrel core, wherein the heating increases a length of the barrel core;

placing the barrel core inside a mold and holding the lengthened barrel core in tension;

adding a carbon fiber mix to the mold, wherein the carbon fiber mix comprises a blend of resin and chopped carbon fibers;

sealing the mold;

curing the carbon fiber mix surrounding the barrel core, wherein the cured carbon fiber mix holds the tension on the barrel core, and wherein the tension increases a rigidity of the rifle barrel;

removing the rifle barrel from the mold; and finishing the rifle barrel via grinding to a desired finish.

2. The method of claim 1, wherein the barrel core comprises steel.

3. The method of claim 1, wherein the chopped carbon fibers comprise non-continuous forged carbon fibers.

4. The method of claim 1, wherein an x-ray detectable material is embedded in the carbon fiber mix.

5. The method of claim 1, wherein reinforcing fibers are placed around the barrel core prior to adding the carbon fiber mix to the mold.

6. The method of claim 1, wherein the mold is subjected to vacuum pressure during curing.

7. The method of claim 1, wherein finishing comprises centerless grinding.

8. The method of claim 1, further comprising the step of applying a protective wax coating to the finished rifle barrel.

9. A method of forming a rifle barrel comprising the steps of:

heating a barrel core to grow a length of the barrel core;

placing the barrel core or a mandrel comprising the barrel core inside a mold;

holding the length of the heated barrel core in place;

adding a carbon fiber mix to the mold to surround the barrel core, wherein the carbon fiber mix comprises a blend of resin and carbon fibers;

sealing the mold;

curing the carbon fiber mix, wherein the cured carbon fiber mix holds the length of the barrel core in place causes a tension on the barrel core when the barrel core cools, and wherein the tension increases a rigidity of the rifle barrel;

removing the rifle barrel from the mold; and finishing the rifle barrel via grinding to a desired finish.

10. The method of claim 9, wherein the barrel core is heated to a temperature between 200° F. and 600° F.

11. The method of claim 9, wherein the barrel core is made of an alloy selected for high thermal expansion properties.

12. The method of claim 9, wherein the carbon fiber mix comprises continuous carbon fibers oriented to enhance rigidity.

13. The method of claim 9, wherein the tension created on the barrel core improves barrel harmonics.

14. The method of claim 9, wherein the mold is pre-coated with a release agent before the carbon fiber mix is added.

15. The method of claim 9, further comprising the step of wrapping the cured rifle barrel with a compression tape before finishing.

16. The method of claim 9, wherein curing is temperature controlled to achieve a specific rifle barrel core length contraction rate.

17. The method of claim 9, wherein the mold is subjected to autoclave curing for improved bonding.

18. The method of claim 9, wherein the barrel core is pre-treated with an adhesion-promoting primer.

19. A method of forming a rifle barrel consisting of:

heating a barrel core to grow a length of the barrel core;

placing a barrel core inside a mold and holding the heated barrel core length in place;

adding a carbon fiber mix to the mold, wherein carbon fiber mix surrounds the barrel core wherein the carbon fiber mix comprises a blend of resin and carbon fibers;

sealing the mold;

curing the carbon fiber mix, wherein the cured carbon fiber mix holds the length of the barrel core creating a tension on the barrel core when the length of the barrel core decreases due to cooling, and wherein the tension increases a rigidity of the rifle barrel;

removing the rifle barrel from the mold; and finishing the rifle barrel.

20. A replacement rifle barrel kit for a firearm comprising the rifle barrel of claim 19.

* * * * *